US005187929A

United States Patent [19]

Meroni et al.

[11] Patent Number: 5,187,929

[45] Date of Patent: Feb. 23, 1993

[54] AUTOMATIC DEVICE FOR RESETTING A MECHANICAL YARN FEELER IN A TEXTILE MACHINE

[75] Inventors: Roberto Meroni; Umberto Gerin, both of Pordenone; Fabio Lancerotto, Milan; Vittorio Colussi, Pordenone, all of Italy

[73] Assignee: Savio S.p.A., Pordenone, Italy

[21] Appl. No.: 863,328

[22] Filed: Apr. 2, 1992

Related U.S. Application Data

[63] Continuation of Ser. No. 509,577, Apr. 16, 1990, abandoned.

[30] Foreign Application Priority Data

Apr. 21, 1989 [IT] Italy ..... 20254 A/89

[51] Int. Cl.[5] ..... D01H 13/16

[52] U.S. Cl. ..... 57/80; 19/0.25

[58] Field of Search ..... 57/261, 80, 83, 87, 57/58.49, 58.83, 264, 279; 28/186, 189; 19/0.2, 0.25

[56] References Cited

U.S. PATENT DOCUMENTS

| | | | |
|---|---|---|---|
| Re. 26,230 | 6/1967 | Escursell-Prat | 57/262 |
| 2,734,334 | 2/1956 | Saunders et al. | 19/0.25 |
| 3,695,017 | 10/1972 | Hori et al. | 57/81 |
| 3,764,773 | 10/1973 | Merkle | 57/81 X |
| 3,911,657 | 10/1975 | Bell et al. | 57/80 X |
| 4,075,445 | 2/1978 | Kempf | 28/187 X |
| 4,091,606 | 5/1978 | Bottcher | 57/83 X |
| 4,098,066 | 7/1978 | Stahlecker | 57/263 X |
| 4,338,773 | 7/1982 | Pozzo et al. | 57/81 X |
| 4,976,018 | 12/1990 | Bollen | 57/264 X |

FOREIGN PATENT DOCUMENTS

| | | |
|---|---|---|
| 2333880 | 7/1977 | France . |
| 362223 | 3/1978 | France . |

*Primary Examiner*—Daniel P. Stodola
*Assistant Examiner*—John Rollins
*Attorney, Agent, or Firm*—George P. Hoare, Jr.

[57] ABSTRACT

An automatic device for positioning a mechanical yarn feeler against a yarn. An extendable arm is provided with a magnet at one end. The magnet is held in a pivotable base which pivots within a limited range on the arm. The magnet actively engages the feeler when the arm is extended and as the arm retracts to lower the feeler onto the yarn, the magnet rotates with respect to the arm. When the magnet rotation reaches its limit, the magnet disengages the feeler and the feeler becomes passively supported on the base. The feeler is then further lowered to rest against the yarn and the arm retracted out of engagement with the feeler.

7 Claims, 2 Drawing Sheets

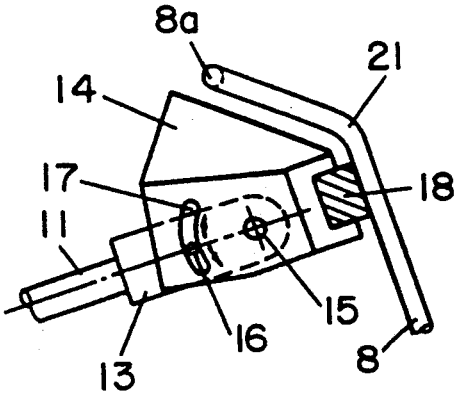
FIG. 1b
FIG. 2
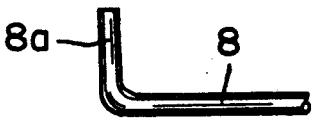

AUTOMATIC DEVICE FOR RESETTING A MECHANICAL YARN FEELER IN A TEXTILE MACHINE

This application is a continuation of application Ser. No. 07/509,577, filed on Apr. 16, 1990, now abandoned.

BACKGROUND OF THE INVENTION

This invention relates to a device for resetting a mechanical yarn feeler in a textile machine, and in particular for automatically repositioning a yarn feeler delicately and accurately so as to prevent any impact with and stressing of the yarn.

SUMMARY OF THE INVENTION

The present invention is directed to a resetting device for a yarn feeler in a textile machine. In particular, the resetting device of the present invention is directed to resetting the yarn feeler in a two-for-one twisting machine. More particularly, the present invention is directed to a resetting device for a yarn feeler in which the resetting movement is divided into two distinct strokes, i.e. a first stroke in which the yarn feeler is pulled to overcome its top dead center position, and a second stroke in which the yarn feeler falls down to its working position, bearing against the yarn, under its own weight. The device according to the invention, still more particularly, has the double function of first pulling the yarn feeler under releasably engaging force, such as magnetic force, until it overcomes its top dead center position (starting from the rest position not bearing against the yarn), and then to simply accompany, such as through passive support, the yarn feeler during its movement in free fall due to gravity so as to bring the yarn feeler into its working position, bearing against the yarn, under conditions so as to avoid any damage to the yarn by the yarn feeler, or bouncing of the yarn feeler.

The present invention is described with reference to a twisting station, but can also be advantageously applied to other processes and machines for yarn production, or in the textile industry generally.

BRIEF DESCRIPTION OF THE DRAWING

FIG. 2 is a side view of an end of arm 8 shown in FIG. 1, which more clearly illustrates L-shaped end 8*a*.

DESCRIPTION OF THE PREFERRED EMBODIMENT

Figure 1A:
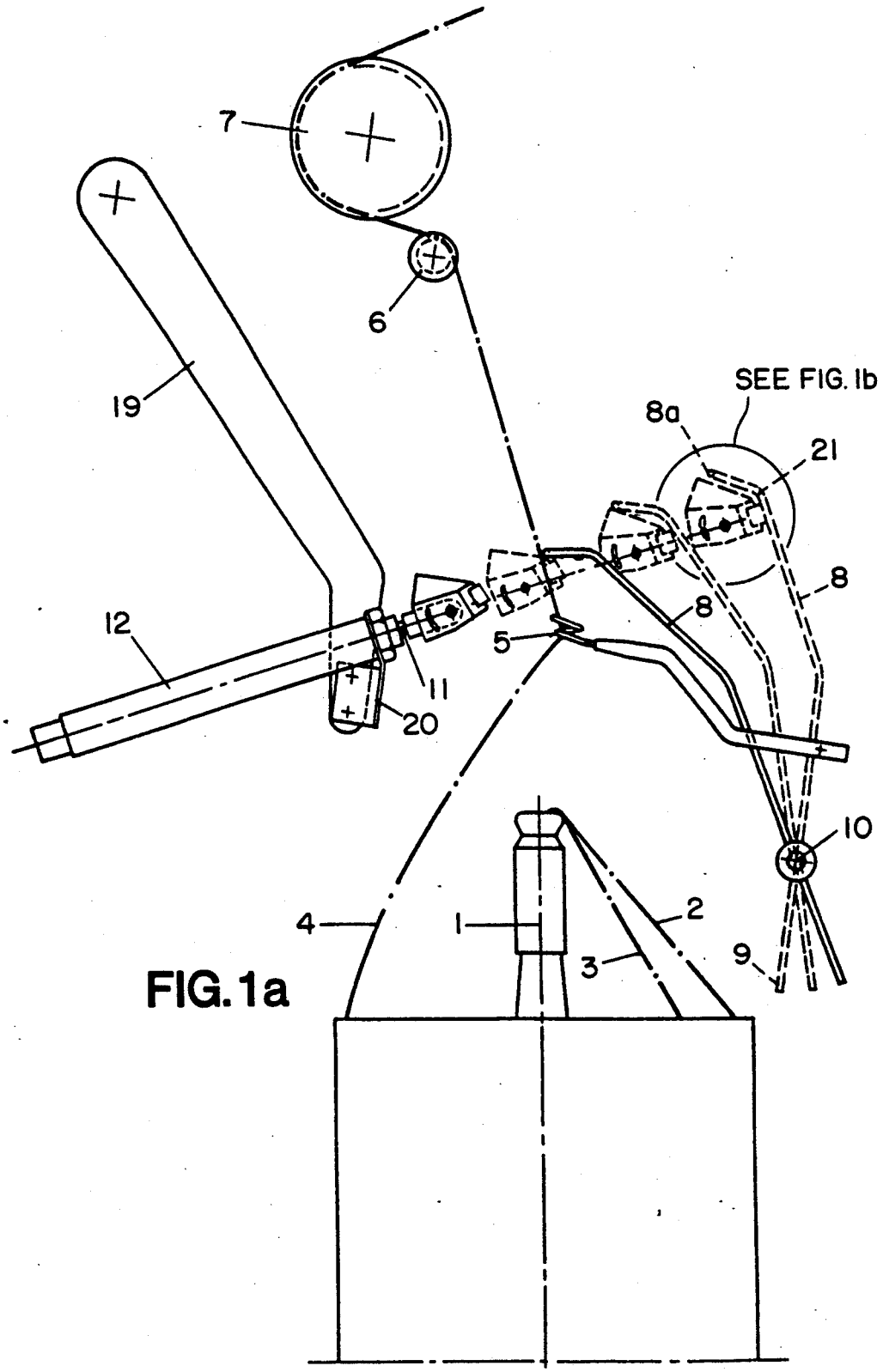
FIG. 1 shows an embodiment of the resetting device of the present invention, with a detailed view of the embodiment shown enlarged within the circle in the figure.

The figure shows that part of a two-for-one twisting station comprising the unwinding head 1 fed with yarns 2 and 3 from underlying feed bobbins, the double twisted yarn 4 passing from the yarn guide ring 5 to the deviator roller 6 and draw-off cylinder 7.

The yarn feeler 8 is shown in the yarn feeler rest position against the stop 9. The yarn feeler is pivoted at 10 and the terminal L-shaped part 8*a* of the yarn feeler 8 has to be brought to bear against the yarn 4 just above the ring 5 and with the horizontal part of the yarn feeler 8*a* orthogonal to the figure.

In twisting stations the yarn feeler 8 halts the twisting operations by falling downwards whenever the yarn breaks. In resetting the yarn the yarn feeler 8 is returned to the indicated rest position, to be returned to the yarn feeler working position on restarting. The yarn feeler 8 generally has a certain weight, and allowing the yarn feeler to fall under its own weight onto the yarn could damage the yarn or indeed bounce the yarn feeler back to the rest position.

The purpose of the device according to the invention is to return the yarn feeler 8 into contact with the yarn 4 accurately and delicately.

The device according to the invention consists of an extendable arm 11 which emerges from and retracts into a cylinder 12 acting as a guide and profiled in such a manner as to prevent the arm 11 rotating about its axis, for example by being of square cross-section, or by the use of an external supplementary rod, the arm being operated pneumatically, hydraulically or mechanically. The arm carries at its end 13 a magnetic engagement member, shown enlarged in the detailed view. The magnetic engagement member consists of a plate 14 able to undergo limited rotation in the plane of the figure by being pivoted on the pivot 15 and comprising a pin 16 which is rigid with the end 13 to allow the plate 14 to swivel through a limited range defined by the slot 17. A magnet member 18 is positioned on the end of the plate 14.

The cylinder 12 can be supported by a further presentation arm 19 by means of the bracket 20.

To reset the yarn feeler 8 the extendable arm 11 is extended until the arm 11 causes the magnet 18 to make contact with the body of the yarn feeler 8.

The plate 14 is designed and positioned so as to allow the magnet 18 to adhere to the body yarn of the feeler over the entire length of the magnet.

The arm 11 is then retracted to pull the yarn feeler 8 with it, and as the yarn feeler rotates about the pivot 10 the magnet 18 and the plates 14 rotate about the pivot 15 as allowed by the pin 16 which slides in the slot 17.

When the allowable rotation has been totally undergone, the magnet 18 is forced to separate from the yarn feeler as the horizontal part 8*a* of this latter rests and is levered on the appropriately inclined surface of the plate 14. The yarn feeler 8 is still supported by the plate 14 because its horizontal part 8*a* slides on the upper face of the plate 14. The slot 17 is sized preferably so that the magnet separates well before the final resting position of the horizontal part 8*a* of the yarn feeler 8 on the yarn is reached.

As the retraction of the arm 11 withdraws the plate 14 beyond the yarn 4, the horizontal part 8*a* of the L-shaped yarn feeler 8 comes to rest softly against the yarn.

The device according to the invention can also be formed without pivoting the plate 14, by giving the magnetic member 18 a curved outer surface to adapt to the curve 21 sliding along it over a portion of the rotary movement of the yarn feeler 8 which enables it to overcome the top dead centre position and then proceed in its movement towards the yarn 4 by simply resting on the body of the plate 14.

We claim:

1. An automatic device for resetting a mechanical yarn feeler in a textile machine, wherein the yarn feeler has an end, said automatic device comprising:

means for moving the yarn feeler from a rest position out of contact with the yarn to a working position in which an end of the yarn feeler bears against the yarn, wherein said means for moving comprises:

an extendable and retractable arm including a support plate and a magnet, means for extending said arm to bring said magnet into engagement with the yarn feeler, and means for retracting said arm to cause the yarn feeler to rotate while adhering to the magnet through a portion of the movement from the rest position to the working position, said means for retracting thereafter releasing the yarn feeler from engagement with said magnet and supporting the yarn feeler with said support plate until the yarn feeler bears against the yarn.

2. The device of claim 1, wherein said arm further comprises an elongated shaft, said support plate being pivotally and rotatably attached to said elongated shaft and wherein said magnet is attached to said support plate, said support plate rotating as said means for retracting retracts said arm to thereby release said magnet from engagement with the yarn feeler.

3. An automatic device for resetting a mechanical yarn feeler in a textile machine as claimed in claim 2, wherein said support plate comprises a slot and wherein said arm further comprises a pin engaging said slot such that said support plate pivots within limits defined by the angular width of said slot in said support plate, said limits defining said portion of the movement of the yarn feeler from the rest position to the working position during which said magnet engages said yarn feeler.

4. The device of claim 1, wherein the yarn feeler has a curved portion and said magnet has a curved external profile for engaging said curved portion of the yarn feeler.

5. An automatic device for resetting a mechanical yarn feeler in a textile machine from a rest position to a working position, said rest position being out of contact with a yarn and said working position being in contact with a yarn, said automatic device comprising:

means for contacting said yarn feeler in its rest position, said means for contacting comprising means for releasably engaging said yarn feeler in the rest position and means for passively supporting said yarn feeler until said yarn feeler is in the working position wherein said means for releasably engaging said yarn feeler comprises a magnet and said means for passively supporting comprises a non-magnetic support plate;

means for moving said means for contacting whereby said yarn feeler is moved from the rest position to the working position; and means for transferring said yarn feeler from said means for releasably engaging to said means for passively supporting.

6. An automatic device for resetting a yarn feeler as claimed in claim 5, wherein said means for moving comprises an extendable and retractable arm on which said means for releasably engaging and said means for passively supporting are carried.

7. An automatic device for resetting a yarn feeler as claimed in claim 5, wherein said means for transferring form part of said means for passively supporting.

* * * * *